US006753786B1

(12) United States Patent
Apperson et al.

(10) Patent No.: US 6,753,786 B1
(45) Date of Patent: Jun. 22, 2004

(54) MICROPROCESSOR-BASED COMBINATION SMOKE AND CARBON MONOXIDE DETECTOR HAVING INTELLIGENT HUSH FEATURE

(75) Inventors: Michael W. Apperson, Chapel Hill, NC (US); John J. Andres, Colorado Springs, CO (US); Joseph G DeLuca, Colorado Springs, CO (US); Chris R. Gilbert, Colorado Springs, CO (US); Larry Ratzlaff, Elgin, IL (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 0 days.

(21) Appl. No.: 09/638,090

(22) Filed: Aug. 11, 2000

(51) Int. Cl.[7] ..... G08B 17/00

(52) U.S. Cl. ..... 340/628; 340/629; 340/630; 340/514; 340/632

(58) Field of Search ..... 340/628, 629, 340/630, 514, 632

(56) References Cited

U.S. PATENT DOCUMENTS

| | | | | |
|---|---|---|---|---|
| 3,909,813 A | | 9/1975 | Scheidweiler et al. | 340/237 |
| 3,953,844 A | | 4/1976 | Barr et al. | 340/237 |
| 4,081,795 A | | 3/1978 | Ogawa | 340/237 |
| 4,097,850 A | | 6/1978 | Conforti | 340/214 |
| 4,196,426 A | | 4/1980 | Ogawa | 340/629 |
| 4,222,046 A | | 9/1980 | Pinckaers et al. | 340/629 |
| 4,254,414 A | | 3/1981 | Street et al. | 340/627 |
| 4,302,753 A | | 11/1981 | Conforti | 340/628 |
| 4,313,110 A | | 1/1982 | Subulak et al. | 340/527 |
| 4,316,184 A | | 2/1982 | Nagel | 340/628 |
| 4,335,378 A | | 6/1982 | Coleman | 340/629 |
| 4,401,978 A | | 8/1983 | Solomon | 340/628 |
| 4,517,555 A | | 5/1985 | Marsocci et al. | 340/522 |
| 4,688,021 A | * | 8/1987 | Buck et al. | 340/521 |
| 4,788,530 A | | 11/1988 | Bernier | 340/527 |
| 4,792,797 A | | 12/1988 | Tanguay et al. | 340/628 |
| 4,814,748 A | | 3/1989 | Todd | 340/527 |
| 4,975,684 A | | 12/1990 | Guttinger et al. | 340/587 |
| RE33,920 E | | 5/1992 | Tanguay et al. | 340/628 |
| 5,422,629 A | | 6/1995 | Minnis | 340/630 |
| 5,428,964 A | | 7/1995 | Lobdell | 62/176.6 |
| 5,726,634 A | | 3/1998 | Hess et al. | 340/628 |
| 5,801,633 A | | 9/1998 | Soni | 340/628 |
| 5,990,797 A | | 11/1999 | Zlotchenko et al. | 340/628 |
| 6,346,880 B1 | | 2/2002 | Schroeder et al. | 340/506 |
| 6,426,703 B1 | * | 7/2002 | Johnston et al. | 340/628 |

* cited by examiner

*Primary Examiner*—Julie Lieu
(74) *Attorney, Agent, or Firm*—Merchant & Gould, P.C.

(57) ABSTRACT

A microcontroller-based hazardous condition detector having an intelligent hush feature is presented. The microcontroller controls the operational mode of the detector by monitoring a single user-actuated switch, the inputs from a smoke chamber and a carbon monoxide detector circuit, and the current operating mode of the detector. When in a normal or no-alarm mode, actuation of the switch will cause the microcontroller to place the detector in a test mode of operation. If the detector is in a carbon monoxide alarm mode, actuation of the switch will act to reset the accumulator function of the microprocessor for the carbon monoxide alarm sensing. If the detector is in a smoke alarm mode, actuation of the switch may place the detector in a hush mode if the level of smoke is sufficiently low, or will have no effect if the level of smoke is too high. Once in the hush mode, actuation of the switch will place the detector into the smoke alarm mode. The microcontroller will also place the detector in the smoke alarm mode if the level of smoke increases beyond a certain limit, and after the expiration of a hush mode time limit. To coordinate this operation, the sensitivity of the detector is not changed in any mode of operation, and the microcontroller monitors both an alarm and a hush threshold.

36 Claims, 5 Drawing Sheets

MICROPROCESSOR-BASED COMBINATION SMOKE AND CARBON MONOXIDE DETECTOR HAVING INTELLIGENT HUSH FEATURE

FIELD OF THE INVENTION

This invention relates generally to the hazardous condition detectors, and more specifically to the hush feature of such detectors.

BACKGROUND OF THE INVENTION

In the past, many people died in their sleep because there was no warning system to awaken them during the early stages of a dwelling fire. Likewise, without a system that could detect the presence of a fire early in its development, many people were trapped in burning buildings once the fire escalated to a point that became easily detectable. Luckily, smoke detectors have been developed which reliably provide an early warning to individuals that a fire may be present. These smoke detectors are so effective in saving lives that they have been mandated as required appliances in many types of dwellings. Current smoke detectors utilize an Application-Specific Integrated Circuit (ASIC), such as the Motorola MC 14467. These ASIC's and their corresponding analog circuitry allow for long battery life, reliable operation, and relatively low cost for these smoke detectors.

It goes without saying that to be effective a smoke detector must be operational. However, since smoke detectors are typically silent, consumers may not know whether or not their detector is operational. While many manufacturers include a feature that provides a periodic chirp as the battery is running low, many individuals desire the capability to affirmatively test the operability of their smoke detector. As such, modern smoke detectors include a push button that, when held in its actuated position, will place the smoke detector in a test mode of operation. This test mode will typically sound the smoke detector alarm after the test button is held for a period of two to three seconds.

While the alarm from a smoke detector is quite effective at warning occupants that smoke has been detected, such smoke does not always mean that a fire exists in the dwelling. Instead, the source of the detected smoke may be under the control of the occupant as, for example, in the situation where the occupant may be cooking in the kitchen. Occasionally, such cooking activities result in the generation of smoke to such a degree that the smoke detector is triggered. In such and other situations the sounding of the smoke detector alarm becomes more of an annoyance than a help.

To accommodate consumer desires to silence the alarm in such situations, while at the same time maintaining functionality of the smoke detector, a hush feature was introduced into conventional smoke detector design. Such a hush feature operates in conventional ASIC-based smoke detectors to reduce the sensitivity of the smoke detectors so that the smoke resulting from consumer-controlled conditions do not result in the sounding of the smoke detector alarm. In such a reduced sensitivity mode of operation, the conventional ASIC-based smoke detectors will sound an alarm if a level of smoke sensed continues to increase beyond the reduced sensitivity level. In this way, the consumers will again be provided with an audible warning indicating that the level of smoke within their dwelling has continued to increase since the hush feature was initiated.

While both the hush feature and the test feature satisfied consumer demands, many smoke detectors provided separate push-button switches to initiate these different modes of operation. Unfortunately, it was found that many consumers were inadvertently actuating the wrong push-button switch and, as a result, were confused by the subsequent operation of their smoke detector. As an example, if the hush button were actuated when the consumer actually wished to determine operability of the smoke detector by entering the test mode of operation, the alarm would not sound, possibly causing the consumer to believe that smoke detector is defective. Likewise, in the situation where the source of smoke is a known consumer-controlled event, actuation of the test button will not silence the smoke detector alarm as desired by the consumer. Such may result in the consumer believing that a larger problem exists within his dwelling, or that the smoke detector is malfunctioning. These problems in selecting the wrong switch are exacerbated by the fact that most smoke detectors are located on or near the ceiling where it is difficult to read the labeling provided for each of these two switches.

In an attempt to provide the desired functionality of both the test mode of operation and the hush mode of operation, many modern smoke detectors are beginning to utilize a single push-button switch, which is capable of actuating both the test mode and the hush modes of operation. One such detector having a hush feature is described in U.S. Pat. No. Re. 33,920 for a SMOKE DETECTOR HAVING VARIABLE LEVEL SENSITIVITY, issued to Tanguay et al. (hereinafter the Tanguay et al. '920 patent). The Tanguay, et al. '920 patent describes an application specific integrated circuit (ASIC) based analog smoke detector circuit having variable level sensitivity for allowing operation exclusively in a normal mode or in a hush mode, and having a test mode, both operable via a single switch.

The Tanguay, et al. '920 patent utilizes a conventional smoke detector ASIC such as the Motorola MC14467. As is conventional with such a smoke detector ASIC, a reference voltage is supplied to pin P13 of the chip. This voltage input is coupled to an input of an analog voltage comparator within the ASIC, and establishes the alarm threshold value against which the output analog voltage from the smoke chamber 30 will be compared. The output voltage from a conventional ionization chamber is coupled to pin P15, which is the other input to the analog voltage comparator within the smoke detector ASIC. As is conventional with this type of device, when the voltage on pin P15 drops below the voltage on pin P13 the ASIC generates an output alarm signal to sound an audible alarm and to light a visible LED.

The smoke detector of the Tanguay, et al. '920 patent also includes a user-actuated switch that initiates both a test mode and a hush mode of operation. Unfortunately, both modes of operation are always entered when the user-actuated switch is activated. That is to say, that hush mode of operation is actuated even if the smoke detector is not currently in an alarm condition and the user solely wishes to check the operability of the detector. In accordance with the teachings of Tanguay, et al. '920, the detector test is initiated by contact of the user-actuated switch to the container of the ionization chamber. As described, this reduces the voltage supplied to the ionization chamber, resulting in a reduced output voltage therefrom. This reduced output voltage is sufficient for the smoke detector ASIC to generate an output alarm signal.

At the same time that the output from the ionization chamber is reduced due to the user-actuated switch completing a circuit to ground from the ionization chamber thereby reducing its input voltage, a test switch sensor circuit conducts current flow to an inhibit control circuit and a time constant circuit. These elements control the hush mode of operation once the user-actuated switch is released. Specifically, during actuation of the switch current flows into the time constant circuit to charge a capacitor through the test switch sensor transistor and a diode. Once the user releases the switch, the time constant circuit now begins operation by draining off the charge of the capacitor through the resistor divider network of R12 and R13. The voltage generated through this resistor divider network is sufficient to turn on the Darlington configured transistor, which reduces the voltage at pin P13. The level to which the voltage on pin P13 is lowered may be adjusted through the proper selection of resistors R15 and R16 and the transistor. These three elements form what is termed a sensitivity control means in the specification of Tanguay, et al. '920. The Darlington configured transistor is referred to in the specification as a diminishing means which diminishes the sensitivity of the smoke detector in response to user actuation of the switch.

While the above-described system attempts to overcome certain problems in the art, it unfortunately introduces other problems that seriously compromise the effectiveness and operability of the detector. Specifically, the limitation that the ASIC introduces with regard to its ability to only sense a single threshold limits the detector to operation solely within the normal sensitivity mode of operation or the reduced sensitivity mode of operation, exclusively. The reduced sensitivity mode remains active even if the amount of smoke in the atmosphere reduces to the point where the normal alarm mode would not be entered. As such, the subsequent generation of a level of smoke that would sound the alarm in a normal sensitivity mode of operation will fail to do so because the detector continues to operate in the reduced sensitivity mode, even though the original condition necessitating the reduced sensitivity mode of operation has long since cleared.

The continued operation in the reduced sensitivity mode of operation highlights another shortcoming of the prior design in that it relies on external timing circuitry as the only mechanism for exiting the reduced sensitivity mode of operation. As described above, once this reduced sensitivity mode of operation has been entered, it will only be exited once the external time-delay circuitry has timed out, regardless of the atmospheric conditions existing within the environment of the detector. Further, while the above-described design attempts to simplify the user interface by providing a single switch to initiate both the test and the hush mode of operation, the use of an analog ASIC design results in both modes of operation being entered upon actuation of the single switch. That is, when the single switch is actuated, both the test mode of operation and the hush mode of operation are entered. As a result, the sensitivity of the detector is reduced even if the user merely wanted to test the operational readiness of the detector. The inadvertent entrance into the reduced sensitivity mode of operation will result in the detector having a reduced sensitivity to smoke for the entire period of the time-out delay.

There is a need existing in the art, therefore, for a smoke detector that utilizes a simplified user interface, but that provides selective initiation of the test mode of operation and the hush mode of operation. Further, there is a need existing in the art for a smoke detector that cancels the hush mode of operation in an intelligent fashion, or as a result of user de-selection thereof. In this way, the hush mode of operation is not continued when the conditions that necessitated its initiation no longer exist.

In addition to smoke detectors, recent advances in hazardous condition detection technology have allowed for the emergence of carbon monoxide detectors supplied to the general public. Such carbon monoxide detectors typically include a sensing element that provides an input to a microprocessor. The microprocessor calculates the total exposure dosage of CO through an accumulator function that correlates carbon monoxide concentration and exposure time. With continuing advances in the carbon monoxide detector technology, these detectors are now available at such a cost and with such a reliability that many manufacturers are now marketing combined smoke and carbon monoxide detectors for use in homes and dwellings.

However, these combination devices typically merely include a conventional ionizing-type smoke detector on the same chassis as a conventional carbon monoxide detector. These two detectors share the same power source and the same alarm system, but they typically independently perform sensing according to the technology of their individual, conventional sensors. Thus, the conventional combination smoke and carbon monoxide detector is not much more than an aggregation. That is, the two units will function independently through independent circuits to sense their independent parameters, but will use the same horn for the alarm. Indeed, the smoke detector portion of the combination units typically still utilizes the Application-Specific Integrated Circuit used in the individual units, and the carbon monoxide portion uses a separate microprocessor for calculating the accumulation dosage of carbon monoxide.

While such aggregate units are being marketed, the cost of these units still reflects the aggregation of both the ASIC and the microprocessor used for the separate smoke and carbon monoxide detection, respectively. Further, in order to allow for the accumulator to be reset a separate carbon monoxide detector reset switch is typically employed in these aggregate units. However, since the functionality of the CO detector is not integrated with the control of the smoke detector (and the initiation of the hush and test modes of operation), this results in two switches once again appearing on the combined detector. As discussed above, multiple switches on the detector may add to consumer confusion.

SUMMARY OF THE INVENTION

In view of the above, it is an object of the instant invention to provide a new and improved smoke detector overcoming the above described and other problems existing in the art. More particularly, it is an object of the instant invention to provide a new smoke detector having an intelligent hush feature and an intelligent test feature. It is a further object of the invention to provide such a detector that utilizes only a single button 18 to intelligently initiate either of these features.

It is an additional object of the invention to provide a combined smoke and carbon monoxide detector having these features. Further, it is an object of the invention that the control for both the smoke and CO detectors is integrated within a single microprocessor or microcontroller 12. It is an additional object of the instant invention to provide a combined smoke and CO detector that utilizes a single push button switch 18 to intelligently initiate the hush mode, the test mode, or reset the CO accumulator. Additionally, it is an object of the instant invention that initiation of any mode or reset of the accumulator will not inadvertently initiate any other mode of operation or inadvertently reset the accumulator.

Fundamentally, the hazardous condition detector of the instant invention represents an advance in technology that provides a more feature-rich detector than has previously been available. As described above, conventional smoke detectors are based on a special purpose ASIC that performs an analog comparison of the smoke chamber 30 voltage against a threshold, and generates an alarm based on the comparison. The new generation detector enabled by the instant invention will perform the comparison and alarm logic digitally in a microcontroller 12. Use of the microcontroller 12 will also allow a true combination detector for smoke and carbon monoxide (CO), in which a common microcontroller 12 handles measurement, calibration and alarm logic for both detectors.

With regard to the smoke detector specific aspect of the invention, additional functionality is provided. The capability to concurrently compare the smoke chamber 30 output with two or more thresholds, impossible in the conventional ASIC design as discussed above, provides a new form of self-clearing, intelligent hush. Conventional smoke detectors lose the ability to monitor the original alarm threshold when in the hush mode, and therefore must rely on a timer circuit to reset hush. In the detector of the instant invention, both the alarm and hush thresholds are concurrently monitored in hush, allowing the hush condition to self clear when the smoke clears from the detector. A digital timing function is provided as a backup to reset hush if the detector has not cleared within the UL mandated reset period. The user is also provided with the heretofore-unavailable option of entering or exiting hush by separately depressing the hush button 18 with an appropriate level of smoke detected. The test mode of operation is entered by depressing the push button switch 18 only if the detector is not in an alarm condition or the hush mode of operation.

With respect to the CO detector specific aspect of the invention, the resetting of the accumulator is accomplished via the same, single push button switch 18 as initiates the hush and test modes of operation. The selectivity provided by the common microcontroller 12 ensures that the accumulator is not inadvertently reset when the user is attempting to enter either the hush or test modes of operation. Specifically, the actuation of the user switch 18 resets the CO accumulator only if the detector is in a CO alarm condition. This selective, intelligent functionality is enabled by the use of a single microcontroller 12 for both the smoke and CO detector portions of the combined unit.

Other objects and advantages of the invention will become more apparent from the following detailed description when taken in conjunction with the accompanying drawings.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 1:
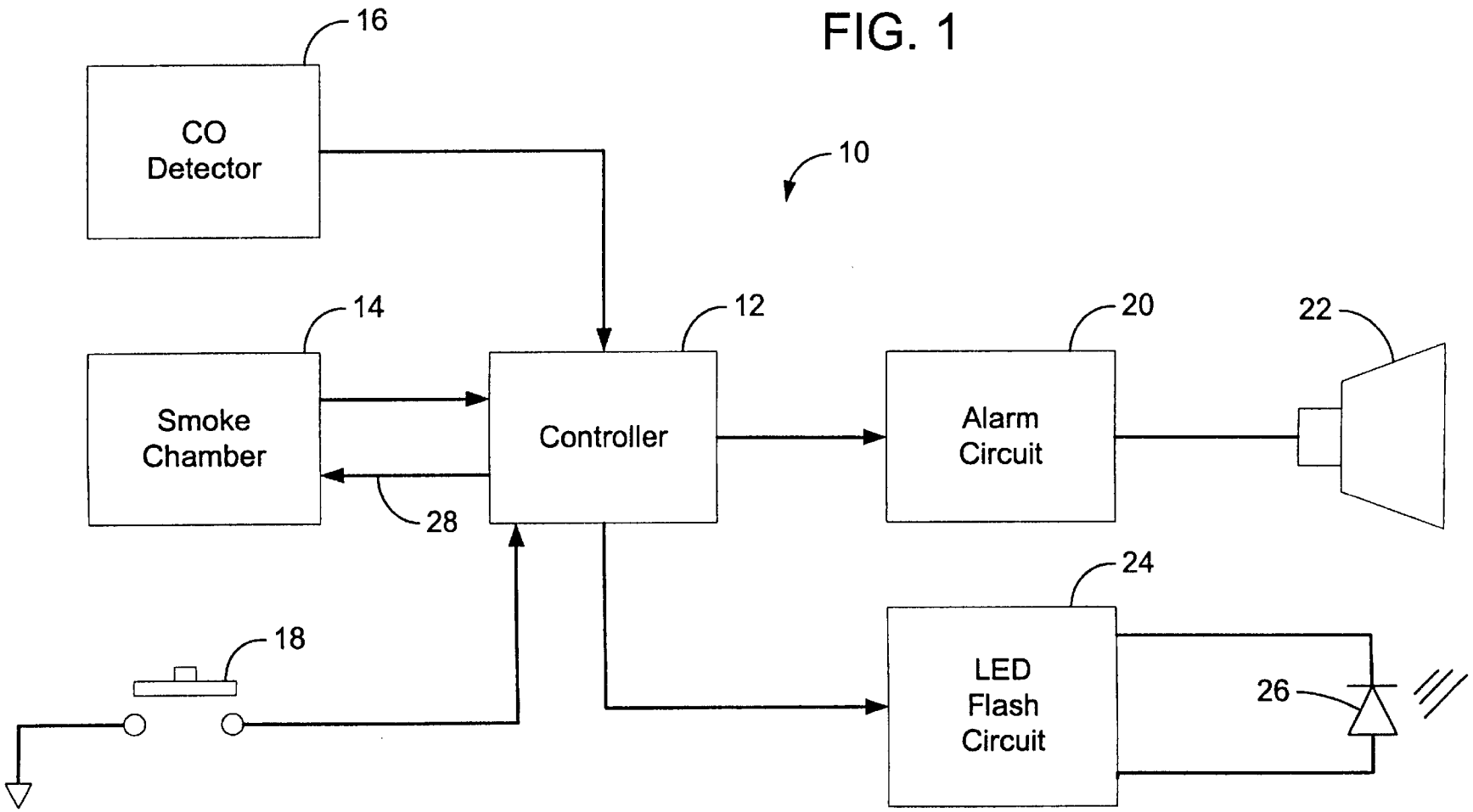
FIG. 1 is a simplified block diagram illustrating a combination smoke and carbon monoxide (CO) detector constructed in accordance with the teachings of the instant invention.

Turning now to the drawings, FIG. 1 illustrates a simplified block diagram of an embodiment of a detector 10 constructed in accordance with the teachings of the instant invention. Specifically, in this embodiment of the instant invention a combined smoke and carbon monoxide detector 10 is illustrated, although it must be noted that alternate embodiments of the instant invention incorporating the teachings thereof may not utilize all of the components illustrated therein. However, in the embodiment illustrated in FIG. 1 a single microcontroller 12 receives input from a conventional ion or photoelectric smoke chamber 14 and a carbon monoxide detector circuit 16. It will be understood from the following that the particular technology of the detector circuits 14, 16 is not a limiting aspect of the invention. Further, while the following discussion will refer to a microcontroller 12, one skilled in the art will recognize that the functionality and intelligence of the instant invention described herein for this element may be alternatively embodied in a microprocessor with associated input/output and buffering circuits, in a programmable logic device (PLD), in an application specific integrated circuit (ASIC), of other intelligent, programmable device. Therefore, the use of the term microcontroller herein shall be construed to cover all of these alternative structures as well.

The microcontroller 12 also receives a single user-actuated switch 18 input. The microcontroller 12 utilizes the inputs from these components 14, 16, and 18 to generate an output alarm condition when the sensed environmental conditions so dictate. A single alarm circuit 20 is utilized to broadcast via alarm 22 the appropriate audible sound, depending on which condition has been detected. The alarm circuit 20 may include both tone and synthesized voice message generation capabilities, or may be a simple piezoelectric type device. The detector 10 of the instant invention may also include a visual warning system, such as the Light-Emitting Diode (LED) flash circuit 24 and accompanying LED 26. As may also be seen from this simplified block diagram of FIG. 1, the microcontroller 12 simulates a hazardous smoke condition via line 28 to allow the microcontroller 12 to test the functionality of the detector 10.

When there is a hazardous level of smoke present, the detector 10 will enter the smoke alarm mode. Actuation of the switch 18 will cause the microcontroller 12 to place the detector 10 in the hush mode. In one embodiment, upon entry into the hush mode a voice synthesized message will be announced once ("Hush Activated"), and a green LED 26 will blink about once every 2 seconds to signify it is in hush mode. Under the normal mode the LED 26 is constantly on, when the unit is in the initiating alarm mode the LED 26 blinks once every second, and when the detector 10 is powered by battery only the LED 26 blinks once every 5 seconds. When the hush mode is canceled for any reason, a voice synthesized message will be announced once ("Hush Canceled"), and the LED 26 will stop blinking every 2 seconds.

Figure 2:
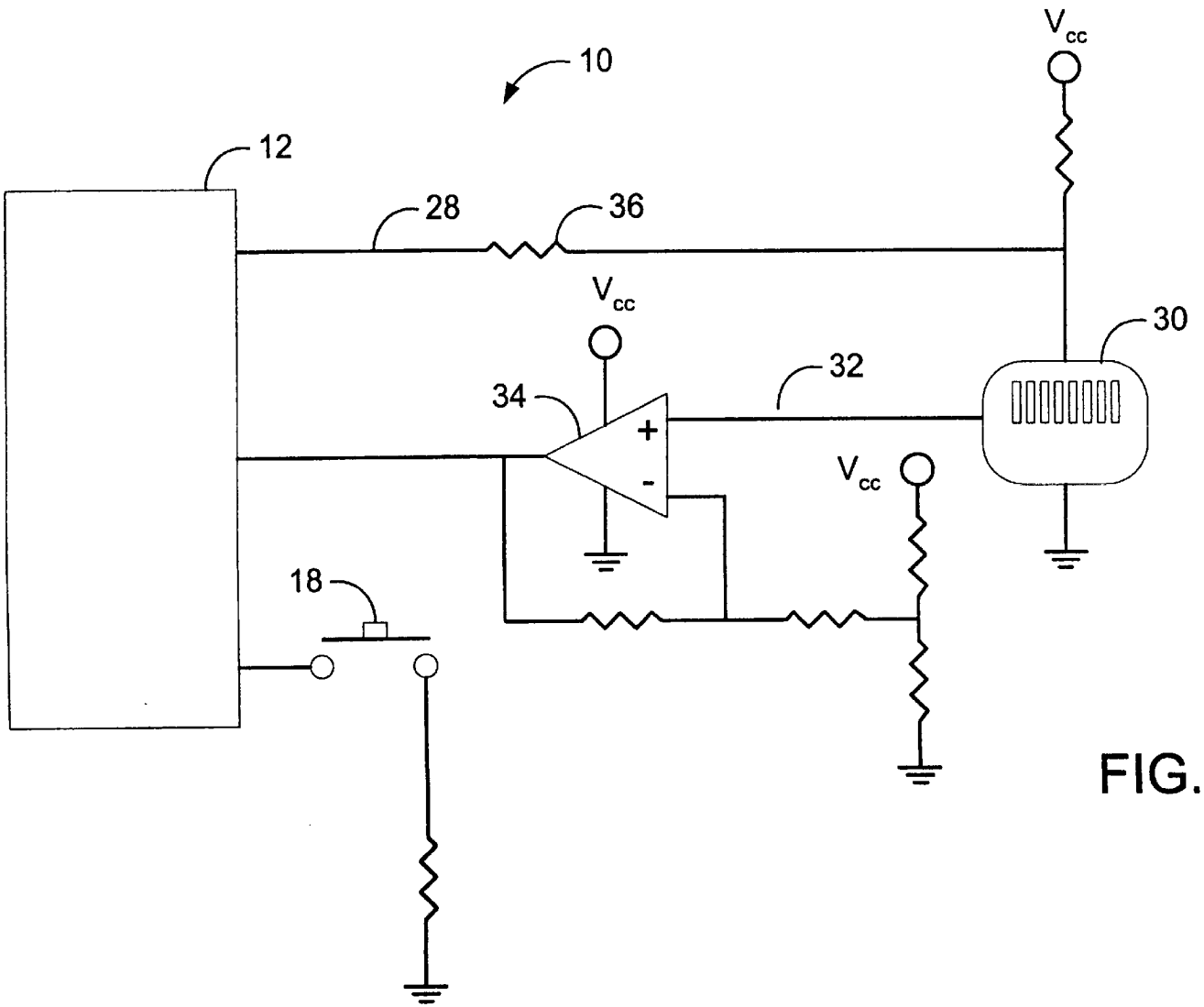
FIG. 2 is a simplified schematic diagram illustrating an aspect of the instant invention.

As may be seen in the simplified schematic of FIG. 2, an embodiment of the detector 10 of the instant invention is a microcontroller-based detector that includes a conventional smoke chamber 30 and a single user-actuated push button 18 to initiate the hush mode and the test mode. Operation of the smoke chamber 30 is conventional, i.e. the output voltage varies as the amount of smoke entering the chamber 30 increases and decreases. Specifically, the output voltage on line 32 from the smoke chamber 30 varies inversely as a function of the amount of smoke sensed by the chamber 30. As the amount of smoke is increased, the output voltage of the chamber 30 decreases.

This output voltage is then buffered or amplified by Op Amp 34 to increase the resolution of the simple analog-to-digital (A/D) converter (not shown) of the microcontroller 12. After the output voltage of the smoke chamber 30 has been converted to a digital value, the internal control logic of the microcontroller 12 compares this digital value to a preprogrammed digital number threshold to determine an alarm condition. Once an alarm condition has been set, the microcontroller utilizes a slightly higher digital threshold to reset the alarm condition, in effect utilizing digital hysteresis to set and reset the smoke alarm condition. No external analog circuitry is required to perform this function as the digital integer threshold values for the set and reset functions are internally stored within the memory of the microcontroller 12.

In an embodiment of the invention a single user-actuated push-button switch 18 is included to initiate either a test mode of operation or a hush mode of operation. The entry into either of these modes is controlled exclusively within the microcontroller 12 based upon the current state of the system 10 at the time the button 18 is actuated. The push button input is sensed only by the microcontroller 12, and does not require any analog connection to circuitry other than the microcontroller 12.

If the smoke detector 10 is not in an alarm condition, actuation of the push button 18 sensed by the microcontroller 12 results in the microcontroller 12 placing the smoke detector 10 in a test mode. Once the microcontroller 12 has entered the test mode, it reduces the supply voltage to the smoke chamber 30 through resistor 36. The output 32 of the conventional smoke chamber 30 is dependent not only on the amount of smoke sensed therein, but also on the input supply voltage. Therefore, as a result of the microcontroller 12 reducing the supply voltage to the smoke chamber 30, the smoke chamber's output voltage 32 decreases. This decreasing smoke chamber 30 output voltage 32 is sensed by the microcontroller 12 which then initiates an alarm. Once the microcontroller 12 has completed its test cycle, it returns the supply voltage to the smoke chamber 30 to its normal value. With the normal supply voltage returned, the output voltage 32 of the smoke chamber 30 again rises to its normal level, which is sensed by the microcontroller 12. The microcontroller 12 then resets the alarm condition.

If the user-actuated switch 18 is depressed during an alarm condition, the microcontroller 12 places the system in the hush mode. Upon detection of user button actuation, the microcontroller 12 first silences the continuous alarm. As illustrated in FIGS. 3–8, the alarm detecting algorithm compares the digitized signal from the smoke chamber 30 against two thresholds, the original threshold 38 and a hush threshold 40 of reduced sensitivity. If the smoke level is above both the hush threshold 40 and the original threshold 38 (signal level less than the stored integer threshold) the alarm sounds at full volume. If the smoke level produces a digitized signal between the two thresholds 38, 40, a hush mode alarm is generated. As soon as the smoke level produces a digitized signal level greater than both thresholds 38, 40, the alarm is silenced and hush is automatically terminated. The microcontroller 12 also increments an internal digital timer 42 for so long as the digitized signal is between thresholds 38, 40, and will terminate hush and sound a continuous alarm if the timer times out. However, by continuing to monitor both threshold values 38,40, the microcontroller 12 may return the detector 10 to normal alarm generation levels at a time potentially much sooner than a traditional time out. This increases the safety of the detector by allowing early warning of a new smoke generation condition.

To inform the user that the unit 10 is in hush and the digitized signal level is between the two thresholds 38,40, a hush alarm is sounded. In an embodiment, the hush alarm will take the form of a flashing LED 26, periodic audible chirps, or both. In an alternative embodiment, a quiet hush alarm will be sounded which will be a continuous (or possibly intermittent) sounding of the alarm at substantially reduced volume. These audible and visible alarms will continue for so long as the detector 10 remains in hush and the microcontroller 12 determines that the digitized signal level remains between the thresholds 38,40. The hush mode can be exited by any of several conditions detected by the microcontroller 12: (a) the clearing of the smoke chamber 30, (b) an increase in smoke level above the hush threshold 40, (c) user actuation of the hush switch 18, or (d) time out of the digitized hush interval 42. It is important to this hush mode of operation that the smoke detector 10 sensitivity at all times remains the same. The microcontroller 12 must continue to compare actual detector readings against both stored limits 38, 40, the hush limit 40 and the alarm limit 38 to determine which of its operating modes should be active (clear, hush, or alarm).

The quiet hush feature of an alternate embodiment emphasizes the significant differences in functionality provided by the new microcontroller-based design. Unlike the typical hush feature implemented in various detectors currently available on the market that completely silences the warning alarm unless the environmental condition increases beyond a new threshold value, the "quiet hush" feature reduces the volume of the alarm to a much reduced decibel level, such as 5 or 10 dB.

By introducing a "quiet hush" mode as opposed to a silent hush mode, consumers are given an unambiguous signal that the smoke detector is still functional, that the smoke level is being measured, and is between the two thresholds 38, 40. The microcontroller 12 continues to monitor both the normal 38 and the hush 40 threshold levels as described above, and maintains the alarm at the lower volume so long as the level of smoke remains between these two levels 38, 40. If the level of smoke increases beyond the lower hush threshold setting, the detector will again increase the decibel output of the alarm signal to at least the required minimum of 85 dB.

In addition to increasing the output volume of the alarm, the detector 10 also cancels the hush mode of operation, as described above. Alternatively, if the level of smoke or other detected condition decreases below the normal threshold value 38 at which the original alarm was sounded, the lower volume alarm and the hush mode will be canceled.

Figure 3:
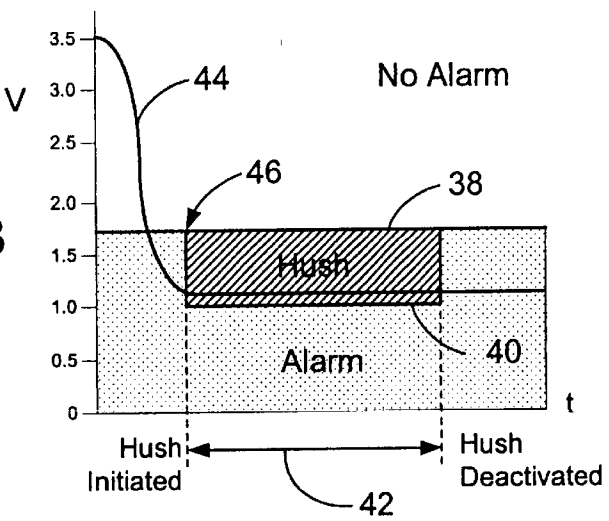
FIG. 3 is a graphical illustration of a smoke chamber 30 output voltage versus time that illustrates an aspect of the intelligent hush feature of the instant invention.

Having now introduced generally the intelligent hush feature enabled by the microcontroller-based detector of the instant invention, attention is now directed to FIGS. 3–8 for a detailed explanation and illustration of each of the various operational aspects of the intelligent hush feature. Turning first to FIG. 3 wherein the smoke chamber 30 output voltage is plotted versus time under varying conditions of smoke in the environment of the detector 10, trace 44 illustrates the smoke chamber 30 output voltage under an increasing smoke condition causing the output voltage 44 to drop below the alarm threshold 38. As the output voltage 44 crosses the threshold 38, an alarm condition is initiated. At point 46 the user push-button switch 18 (see FIG. 1) is actuated. The microcontroller 12 then places the detector 10 in the hush mode of operation because the output of the smoke chamber is between the alarm threshold 38 and the hush threshold 40. As may be seen from this figure, if the output voltage illustrated as trace 44 remains within these two thresholds 38, 40, the microcontroller 12 will automatically disable the hush feature after a predetermined duration 42. Preferably this duration is approximately ten (10) minutes, although any duration that meets regulatory requirements is possible. Once this time period 42 has expired, the microcontroller 12 then places the detector 10 back into the alarm mode without the necessity of any user intervention.

Figure 4:
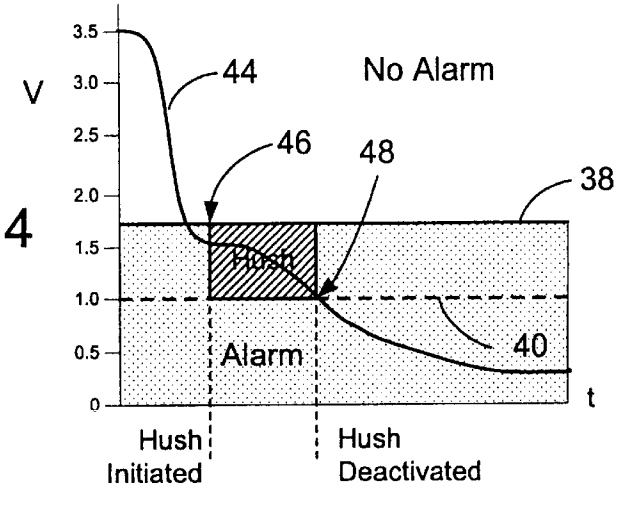
FIG. 4 is a graphical illustration of a smoke chamber 30 output voltage versus time that illustrates an additional aspect of the intelligent hush feature of the instant invention.

As may be seen from the graph of FIG. 4, as the output voltage 44 decreases below the alarm threshold 38, the microcontroller 12 places the detector 10 into an alarm condition as described above. Likewise, actuation of the user switch 18 at point 46 places the detector 10 in the hush mode of operation. However, as may be seen from this FIG. 4, if the output voltage 44 were to continue to drop below the hush threshold 40 as illustrated at point 48, the microcontroller 12 automatically disables the hush mode of operation and places the detector 10 into an alarm condition. Unlike prior hush designs, if the output voltage 44 increases above hush threshold 40 but remains below alarm threshold 38, the detector 10 will remain in an alarm condition unless and until the user-actuated switch 18 is again depressed. Prior systems that rely solely on a time-out to reset the hush mode of operation may again disable the alarm once this hush threshold had been crossed, even though the increased amount of smoke had necessitated the exit from hush mode just prior to a level of smoke subsiding somewhat. However, since the microcontroller 12 of the instant invention utilizes digital logic to determine the appropriate mode of operation of the detector 10, such inadvertent operation is precluded once the hush mode of operation has been exited.

Figure 5:
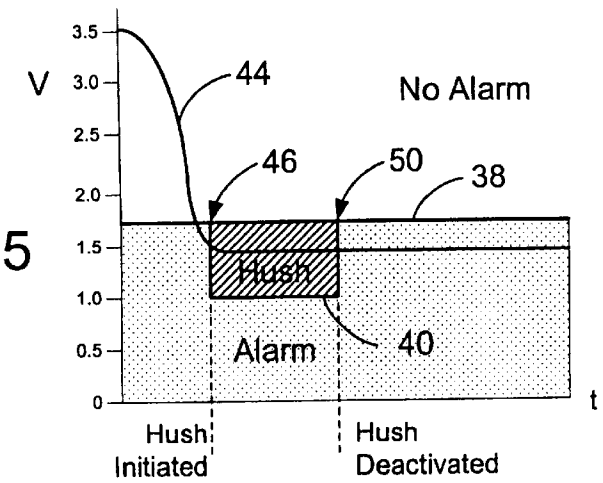
FIG. 5 is a graphical illustration of a smoke chamber 30 output voltage versus time that illustrates yet an additional aspect of the intelligent hush feature of the instant invention.

In addition to automatic control, FIG. 5 illustrates the microcontroller's ability to allow user intervention once the hush mode of operation has been entered. Specifically, trace 44 once again illustrates the increasing amount of smoke causing the output voltage of the smoke chamber 30 to decrease below the alarm threshold 38. As with the prior figures, the user actuates switch 18 at point 46 to cause the detector 10 to enter the hush mode of operation. Since the microcontroller receives the push-button input, and utilizes its control algorithms to determine appropriate detector state, actuation of the push-button 18 during the hush mode of operation at point 50 results in the microcontroller 12 disabling the hush mode of operation. Since the level of smoke remains below the alarm threshold 38, the detector 10 will again be placed in the alarm mode of operation by the microcontroller 12. This will clearly provide an indication to the user that the detector 10 is fully operational and sensing a level of smoke that is greater than the alarm threshold. If the user were to actuate the push-button switch 18 once again, the hush mode of operation would again be entered, so long as the output voltage 44 remains between the two thresholds 38, 40.

Figure 6:
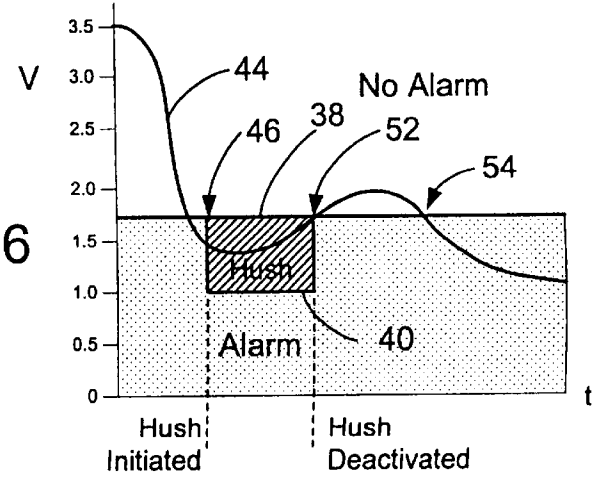
FIG. 6 is a graphical illustration of a smoke chamber 30 output voltage versus time that illustrates a further aspect of the intelligent hush feature of the instant invention.

An additional aspect of the automated control for the hush feature provided by microcontroller 12 is illustrated in FIG. 6. As the output from the smoke detector 44 drops below the alarm threshold 38, the microcontroller 12 places the detector 10 into the alarm mode of operation. As with the above, the user-actuated switch is depressed during this alarm mode at point 46 to place the detector in the hush mode of operation. If the output voltage 44 were to increase above threshold 38, indicating that the amount of smoke sensed by the smoke chamber 30 had decreased, the microcontroller 12 disables the hush mode of operation. If the amount of smoke again increases as indicated in FIG. 6 by the decrease of voltage trace 44 below threshold 38 at point 54, the microcontroller 12 will again place the detector 10 in an alarm mode of operation.

This presents a significant safety advantage over conventional hush designs, especially where point 52 and point 54 are within the hush time-out of the conventional detectors. With these conventional detectors, once the hush mode of operation has been entered, it will remain active until the time-out circuitry expires. Therefore, a second smoke-generating condition will not produce an alarm until the hush level has been crossed. With the system of the instant invention, once the initial smoke-generating event has ended or subsided to the point where the alarm threshold is no longer crossed, the re-appearance of smoke will again be signaled to the user at the original alarm level 38. In such a situation, the user is provided with an earlier warning that a new condition exists, or that the prior condition has not fully been extinguished. Since the original alarm threshold 38 is used to provide this early warning, the user may attend to the condition before it generates a significant amount of smoke such to cross the hush threshold 40.

Figure 7:
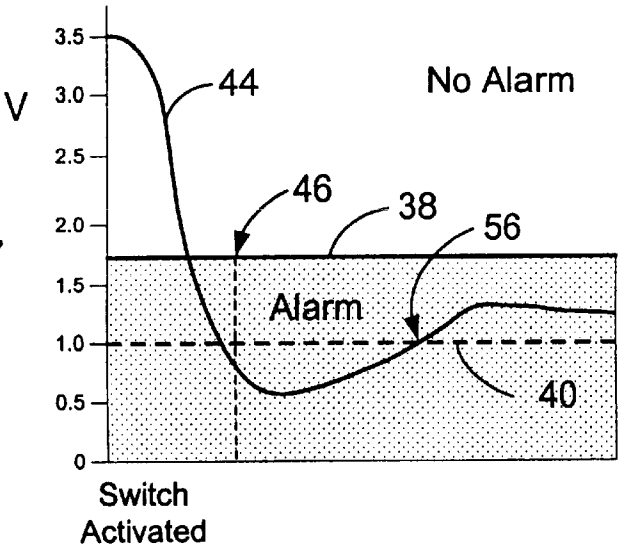
FIG. 7 is a graphical illustration of a smoke chamber 30 output voltage versus time that illustrates a still further aspect of the intelligent hush feature of the instant invention.

FIG. 7 illustrates a further advantage provided by the microcontroller-controlled hush feature. In this illustration, the user-actuated switch 18 is not depressed until after the output voltage 44 has crossed both the alarm threshold 38 and the hush threshold 40. In such a situation, the microcontroller 12 does not place the system 10 into the hush mode of operation because the level of smoke is too great at the point of switch actuation 46. If the amount of smoke were to subside slightly such that the output voltage 44 was to cross the hush threshold 40 at point 56, the alarm condition is maintained. This also illustrates a distinction between the microcontroller-based hush feature of the instant invention and conventional ASIC/analog-based systems. Specifically, in the prior systems, the only way to terminate the hush mode of operation and return the detector to its normal level of sensitivity is for the time-out circuitry to expire. This is so even though the hush mode of operation was never properly entered because the level of smoke was too great at the time of user switch actuation. However, under such circumstances the alarm would be disabled at point 56 because the reduced sensitivity mode of operation would still dominate the analog circuitry until the time-delay circuitry expired. This may provide the users of a false sense of security thinking that the smoke condition has cleared.

In the system of the instant invention, on the other hand, since the hush condition is never properly entered, the microcontroller 12 continues to maintain the alarm condition until the level of smoke reduces below the alarm threshold 38. This will ensure that the detector continues to provide an audible alarm unless and until the smoke clears below the alarm threshold level, or the user actuates the switch to enter the hush mode of operation once the smoke has reduced to a point such that the hush threshold 40 is no longer breached. As illustrated in FIG. 7, this would be after point 56. If the switch were actuated after point 56, the hush mode of operation will be entered as described above.

Figure 8:
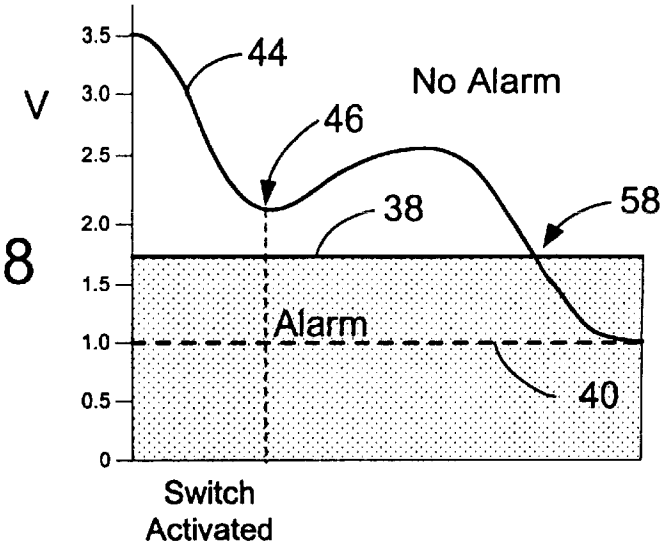
FIG. 8 is a graphical illustration of a smoke chamber 30 output voltage versus time that illustrates a further additional aspect of the intelligent hush feature of the instant invention.

In a similar manner as illustrated in FIG. 8, if the user were to depress the push button 18 at a point 46 when the output voltage 44 is above the alarm threshold 38, the hush mode of operation will not be entered. As such, an increase in smoke in the smoke chamber 30 resulting in the output voltage 44 dropping below alarm threshold 38 at point 58 will generate an alarm condition. As with the above, this presents a significant advantage over prior hush systems that do not have the intelligence to recognize that the hush mode should not be entered (which reduces their sensitivity) when the button is pushed if the detector is not in an alarm condition with a moderate level of smoke, and over prior hush systems that relied solely on the time-out of a time-delay circuit to return the detector to its normal level of sensitivity to smoke once hush has been initiated. That is, if the level of smoke were to increase such that point 58 was achieved prior to the expiration of the time-delay circuitry, no alarm would be generated to warn the user that the level of smoke had increased above the normal alarm level. Indeed, the conventional ASIC/analog design would not provide an alarm signal to warn the occupants of the increasing amount of smoke until the hush threshold 40 were actually crossed. With the microcontroller 12 of the instant invention, an earlier warning may be provided at point 58 as soon as the original alarm threshold 38 is breached.

Figure 9:
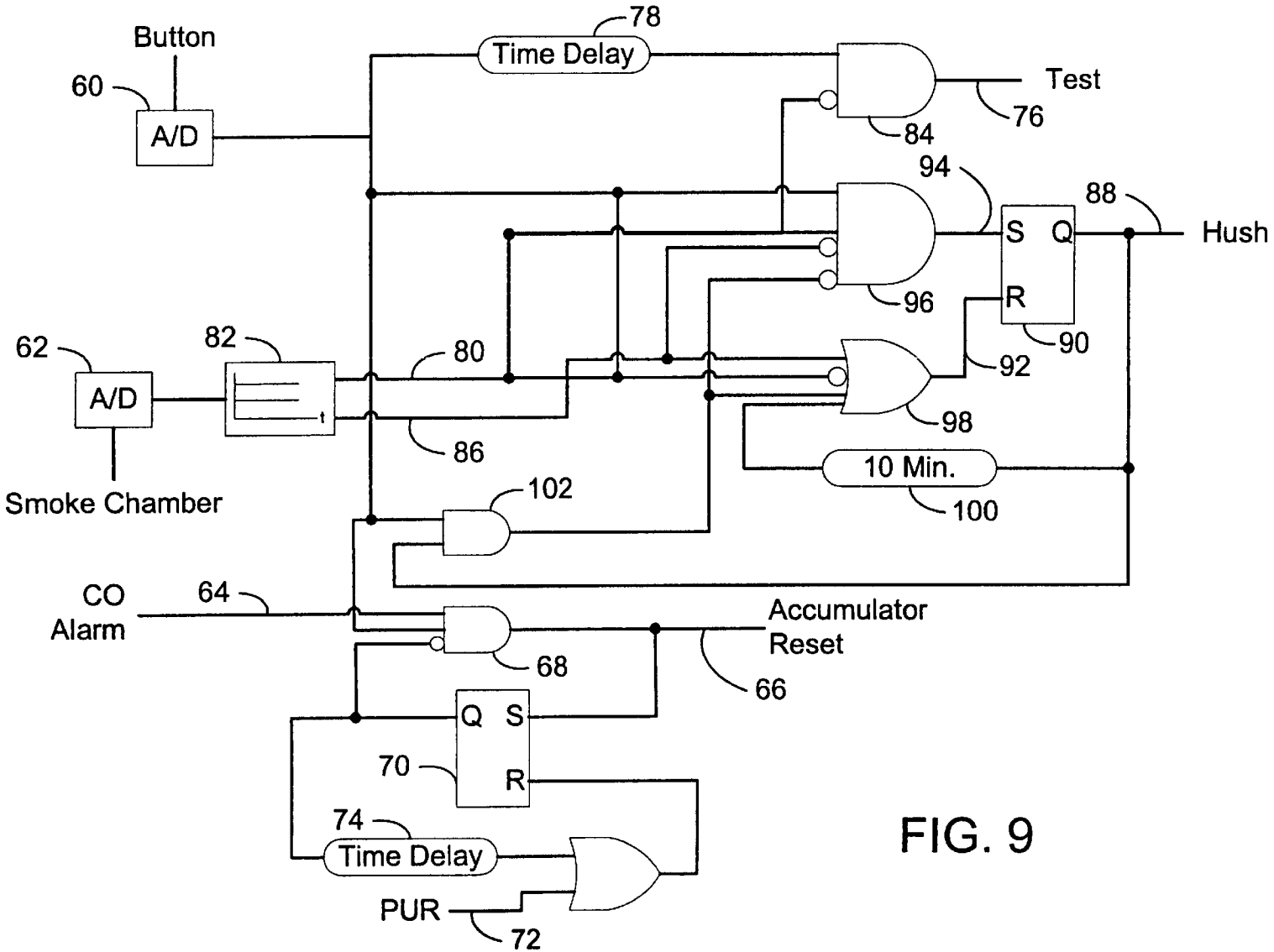
FIG. 9 is a simplified logic diagram illustrating an embodiment of the control logic of the detector of the instant invention.

With the functional operation of the microcontroller hush feature now well in hand, attention is directed to FIG. 9, which illustrates an embodiment of the control logic contained within microcontroller 12. This control logic within the microcontroller 12 receives the user-actuated switch 18 input through an analog-to-digital converter 60. Also, the input voltage from smoke chamber 30 is received through an analog-to-digital converter 62. The input from the carbon monoxide detector is also conditioned through an analog-to-digital converter (not shown), and a carbon monoxide alarm condition 64 is generated in accordance with conventional accumulation techniques within the microcontroller.

This carbon monoxide alarm signal 64 is utilized by the microcontroller 12 to place the detector 10 into the correct state upon sensing user actuation of switch 18. The actual generation of the CO alarm signal is in keeping with conventional techniques and will not be described further herein. However, if the detector 10 is in a carbon monoxide alarm condition 64, and the user-actuated switch 18 is depressed, the microcontroller 12 will generate an accumulator-reset signal 66. Once this accumulator-reset signal 66 has been generated by AND gate 68, this signal is latched by S/R latch 70. This latched signal disables AND gate 68 and removes the accumulator-reset signal 66, so that the accumulator may again begin processing the input carbon monoxide information. Repeated actuation of switch 18 when the carbon monoxide alarm signal 64 has been generated may be precluded from continuously resetting the carbon monoxide accumulator through the use of this latch 70 until either power is cycled to the detector indicated by the power-up reset signal 72, or after a period of delay as set by time-delay 74. In an alternative embodiment, this accumulator-reset signal 66 is not disabled via latch 70, and instead is dependent solely on the existence of the CO alarm signal 64 and the actuation of button 18.

With attention now on the portion of the microcontroller's logic related to the smoke detector, FIG. 9 illustrates that the test mode of operation indicated by signal 76 may be entered after the button 18 has been held longer than a time-delay 78 if the detector is not in an alarm condition as indicated by the absence of signal 80. That is, AND gate 84 generates the test signal 76 when the push button 18 is held for longer than the preset time-delay 78 when the detector is not in an alarm condition. As illustrated in this FIG. 9, the smoke chamber analog-to-digital input is processed by control block 82, which compares the input digital count against various preset alarm limits used therein. Signal 80 indicates that the smoke chamber output voltage is below the alarm threshold 38, and output signal 86 indicates that the smoke chamber output voltage is below the hush threshold. This control block 82 implements digital hysteresis by utilizing thresholds slightly higher than thresholds 38 and 40 to reset the alarm and hush conditions once those conditions have been set. The amount of digital hysteresis employed is dependent on the sensitivity and resolution of the sensing circuitry 30, the amplification circuitry 34, and the resolution of the analog-to-digital converter 62, as well as on the user specifications.

The hush mode of operation is indicated by signal 88, which is the latched output of latch 90 whose reset conditions 92 override its set conditions 94. By having the reset conditions 92 override the set conditions 94 of latch 90, the normal alarm mode providing early indication to the user of a hazardous condition will be entered if both the reset and set conditions are true at the same point. This provides an additional safety feature of the control logic of the instant invention. To generate the set conditions 94, AND gate 96 requires that the button 18 be depressed, that the smoke chamber output voltage be below the alarm threshold but above the hush threshold, and that the system is not currently already in the hush mode of operation prior to the button push. This control logic may reset the hush condition via OR gate 98 after the expiration of time-delay 100, upon actuation of the user button while in the hush mode as calculated by AND gate 102, as soon as the smoke chamber voltage rises above the alarm threshold, or as soon as the output of the smoke chamber drops below the hush threshold. As will be recognized, each of these four conditions for disabling the hush mode of operation are illustrated in FIGS. 3, 5, 6, and 4, respectively.

While FIG. 9 illustrates a control-logic diagram illustrating the control logic used by the microcontroller 12 to intelligently control the system mode of operation upon detection of the user-actuated switch 18, one skilled in the art will recognize that this control logic may be coded in different fashions utilizing algorithms which vary from the exact structure of the logic illustrated in FIG. 9, but which results in system operation as illustrated FIGS. 3–8. Therefore, it must be recognized that the control logic of FIG. 9 is presented by way of illustration, and not by way of limitation.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A hazardous condition detector, comprising:

a smoke chamber positioned to sense an atmospheric condition, the smoke chamber generating an output indicative of an amount of smoke sensed therein;

a user-actuated switch;

an alarm circuit;

a microcontroller coupled to receive the output of the smoke chamber and the switch, and further operably coupled to the alarm circuit for controlling generation of an alarm therefrom, the microcontroller having an alarm threshold and a hush threshold stored therein, and being operable to place the detector in an alarm mode when the output from the smoke chamber drops below the alarm threshold, in a hush mode upon sensing actuation of the switch when in the alarm mode and when the output of the smoke chamber is above the hush threshold, and in a test mode upon sensing actuation of the switch when not in the alarm mode and not in the hush mode.

2. The detector of claim 1, wherein the microcontroller is further operable in the hush mode to place the detector in the alarm mode upon expiration of a time delay.

3. The detector of claim 1, wherein the microcontroller is further operable in the hush mode to place the detector in the alarm mode when the output from the smoke chamber drops below the hush threshold.

4. The detector of claim 3, wherein the microcontroller is further operable to maintain the detector in the alarm mode until the output from the smoke chamber rises above the alarm threshold.

5. The detector of claim 1, wherein the microcontroller is further operable in the hush mode to place the detector in the alarm mode upon sensing actuation of the switch.

6. The detector of claim 1, wherein the microcontroller is further operable in the hush mode to place the detector in a normal mode when the output from the smoke chamber rises above the alarm threshold.

7. The detector of claim 1, wherein the microcontroller commands the alarm circuit to generate no alarm in the hush mode.

8. The detector of claim 1, wherein the microcontroller commands the alarm circuit to generate an alarm of substantially reduced volume in the hush mode as compared to the alarm mode.

9. The detector of claim 8, wherein the alarm of substantially reduced volume is less than 10 dB.

10. The detector of claim 8, wherein the alarm of substantially reduced volume is approximately 5 dB.

11. The detector of claim 1, wherein the alarm circuit produces tone and voice synthesized messages, and wherein the alarm circuit produces a voice synthesized announcement upon entering and exiting hush mode.

12. The detector of claim 1, further comprising a visual alert circuit, and wherein the microcontroller is operable to command the visual alert circuit to provide separate visual indications for the alarm mode and the hush mode.

13. The detector of claim 1, further comprising a carbon monoxide detector positioned to sense an atmospheric condition, wherein the carbon monoxide detector provides information indicative of an amount of carbon monoxide sensed thereby, and wherein the microcontroller accumulates the information to determine a carbon monoxide alarm condition, the microcontroller resetting the accumulation of the information upon sensing actuation of the switch when in the carbon monoxide alarm condition.

14. A hazardous condition detector, comprising:

a carbon monoxide detector circuit positioned to sense an atmospheric condition, the carbon monoxide detector circuit operable to produce an output indicative of the amount of carbon monoxide detected thereby;

a smoke chamber positioned to sense an atmospheric condition, the smoke chamber operable to generate an output indicative of an amount of smoke sensed therein;

an alarm circuit;

a microcontroller coupled to receive the output of the carbon monoxide detector circuit and the output of the smoke chamber, and operably coupled to the alarm circuit, the microcontroller having an alarm threshold and a hush threshold stored therein, and being operable to place the detector in a smoke alarm mode commanding the alarm circuit to generate an alarm when the output of the smoke chamber descends below the alarm threshold stored therein, and in a carbon monoxide alarm mode when an accumulation of the output of the carbon monoxide detector circuit exceeds an accumulation threshold stored within the microcontroller.

15. The detector of claim 14, further comprising an user-actuated switch, the microcontroller controlling an operating mode of the detector based on a current operating mode upon sensing actuation of the switch.

16. The detector of claim 15, wherein the microcontroller places the detector in a hush mode upon sensing actuation of the switch when in the alarm mode and when the output of the smoke chamber is above a hush threshold.

17. The detector of claim 16, wherein the microcontroller places the detector in a test mode upon sensing actuation of the switch when not in the alarm mode and not in the hush mode.

18. The detector claim 16, wherein the microcontroller places the detector in the alarm mode upon expiration of a time delay after initiation of the hush mode.

19. The detector of claim 16, wherein the microcontroller places the detector in the alarm mode when the output from the smoke chamber drops below the hush threshold when in the hush mode.

20. The detector of claim 19, wherein the microcontroller is further operable to maintain the detector in the alarm mode until the output from the smoke chamber rises above the alarm threshold.

21. The detector of claim 16, wherein the microcontroller places the detector in the alarm mode upon sensing actuation of the switch when in the hush mode.

22. The detector of claim 16, wherein the microcontroller places the detector in a normal mode when the output from the smoke chamber rises above the alarm threshold.

23. The detector of claim 15, wherein the microcontroller resets the accumulation of carbon monoxide information upon actuation of the switch when in the carbon monoxide alarm mode.

24. The detector of claim 15, wherein the microcontroller places the detector in a test mode upon actuation of the switch when in a normal mode.

25. The detector of claim 16, wherein the microcontroller commands the alarm circuit to generate no alarm in the hush mode.

26. The detector of claim 16, wherein the microcontroller commands the alarm circuit to generate an audible alarm of substantially reduced volume in the hush mode as compared to the alarm mode.

27. The detector of claim 26, wherein the audible alarm of substantially reduced volume is less than 10 dB.

28. The detector of claim 26, wherein the audible alarm of substantially reduced volume is approximately 5 dB.

29. The detector of claim 14, wherein the alarm circuit produces tone and voice synthesized messages, and wherein the alarm circuit produces a voice synthesized announcement upon entering and exiting a hush mode.

30. The detector of claim 14, further comprising a visual alert circuit, and wherein the microcontroller is operable to command the visual alert circuit to provide separate visual indications for the alarm mode and the hush mode.

31. A smoke detector, comprising:

a smoke chamber positioned to sense an atmospheric condition, the smoke chamber generating an output indicative of an amount of smoke sensed therein;

an alarm circuit;

a microcontroller coupled to receive the output of the smoke chamber, and further operably coupled to the alarm circuit for controlling generation of an alarm therefrom, the microcontroller having an alarm threshold stored therein, and being operable to place the detector in an alarm mode when the output from the smoke chamber drops below the alarm threshold, said microcontroller further having an alarm off threshold stored therein, and being operable to place the detector in a no alarm mode when the output from the smoke chamber rises above the alarm off threshold when in the alarm mode.

32. The smoke detector of claim 31, further comprising:

a user actuatable switch having an output coupled to the microcontroller; and wherein said microcontroller contains a hush threshold stored therein, said microcontroller operable to place the detector in a hush mode upon sensing actuation of the switch when in the alarm mode and when the output of the smoke chamber is above the hush threshold.

33. The smoke detector of claim 31, further comprising:

a user actuatable switch having an output coupled to the microcontroller; and wherein said microcontroller places the detector in a test mode upon sensing actuation of the switch when not in the alarm mode.

34. The smoke detector of claim 31, further comprising:

a user actuatable device having an output coupled to the microcontroller; and wherein said microcontroller contains a hush threshold stored therein, said microcontroller operable to place the detector in a hush mode upon sensing actuation of the switch when in the alarm mode and when the output of the smoke chamber is above the hush threshold, the microcontroller further operable to place the detector in a test mode upon sensing actuation of the switch when not in the alarm mode and not in the hush mode.

35. A hazardous condition detector, comprising:

a detector circuit positioned to sense an atmospheric condition, the detector circuit generating an output indicative of the condition sensed;

a user-actuated switch;

an alarm circuit; and a microcontroller coupled to receive the output of the detector circuit and the switch, and further operably coupled to the alarm circuit for controlling generation of an alarm therefrom, the microcontroller having a first value and a second value stored therein;

wherein the microcontroller is operable to place the detector in an alarm mode when the output from the detector circuit drops below the first value, and in a hush mode upon sensing actuation of the switch when in alarm mode and when the output of the detector circuit is above the second value.

36. A hazardous condition detector of claim 35, further comprising an amplifier for amplifying the output of the detector circuit.

* * * * *